US007124793B1

(12) United States Patent
Jensen

(10) Patent No.: US 7,124,793 B1
(45) Date of Patent: Oct. 24, 2006

(54) PORTABLE PLANER FOR A SINGLE USE STAND

(76) Inventor: Robert L Jensen, Box 477, Haines, AK (US) 99827

( * ) Notice: Subject to any disclaimer, the term of this patent is extended or adjusted under 35 U.S.C. 154(b) by 290 days.

(21) Appl. No.: 10/784,395

(22) Filed: Feb. 23, 2004

(51) Int. Cl.
*B27C 1/00* (2006.01)

(52) U.S. Cl. ..... 144/117.4; 144/135.3; 144/114.1; 144/129; 144/130; 409/204

(58) Field of Classification Search ..... 144/117.4, 144/135.3, 114.1, 129, 130; 83/574; 409/184, 409/204, 212
See application file for complete search history.

(56) References Cited

U.S. PATENT DOCUMENTS

| | | | | | |
|---|---|---|---|---|---|
| 6,339 | A | * | 4/1849 | Sheldon et al. | 144/242.1 |
| 520,581 | A | * | 5/1894 | Stuart | 144/130 |
| 561,367 | A | * | 6/1896 | Badger | 125/1 |
| 800,962 | A | * | 10/1905 | Wattles | 451/352 |
| 812,461 | A | * | 2/1906 | Staley | 144/134.1 |
| 1,580,155 | A | * | 4/1926 | Niestradt | 125/4 |
| 1,583,879 | A | | 5/1926 | Hallock | |
| 2,232,416 | A | * | 2/1941 | Taylor et al. | 144/114.1 |
| 2,411,257 | A | * | 11/1946 | Friedman et al. | 144/117.4 |
| 2,891,451 | A | * | 6/1959 | Hess | 409/235 |
| 3,434,385 | A | * | 3/1969 | Ray | 409/109 |
| 3,913,642 | A | * | 10/1975 | Porter | 144/114.1 |
| 3,935,777 | A | | 2/1976 | Bassett | |
| 4,265,284 | A | | 5/1981 | Taylor | |
| 4,405,002 | A | * | 9/1983 | Catalano | 144/2.1 |
| 4,660,454 | A | | 4/1987 | Elsey | |
| 4,817,693 | A | | 4/1989 | Schuler | |
| 4,945,959 | A | * | 8/1990 | Biedenbach | 144/137 |
| 5,201,351 | A | | 4/1993 | Hurdle, Jr. | |
| 5,307,718 | A | * | 5/1994 | Perry et al. | 83/875 |
| 5,396,938 | A | | 3/1995 | Cannaday | |
| 6,080,041 | A | | 6/2000 | Greenland | |
| 6,105,477 | A | | 8/2000 | Olson | |

FOREIGN PATENT DOCUMENTS

| | | |
|---|---|---|
| DE | 4.212.460 | 10/1993 |
| GB | 2.128.546 | 2/1984 |

* cited by examiner

*Primary Examiner*—Bena Miller
(74) *Attorney, Agent, or Firm*—Michael I. Kroll

(57) ABSTRACT

An apparatus for a portable planer 12 having rails 14 with means for mounting to a single use stand 16, 18. The planer 12 has a pair of rails 14 with bolts 48 depending from the base thereof having threads with nuts 50 positioned on the distal ends whereby a stand 16, 18 having been constructed on site and leveled regardless of ground slope has means for receiving the threaded bolts 48 whereupon fasteners may be placed on the rail post distal ends whereby the rails form an integral part of the single use stand. The motorized planer 12 is mounted to a carriage 40 having wheels 42 for mounting on the rails 14 whereby the planer can be selectively moved from one rail end to the other. Positioned between the single use rail mounts are supports 26 for placing the work piece thereon for processing with the planer having means for receiving various blades 56, 58 and means for varying 62, 64 the height of the blade relative to the work piece.

15 Claims, 15 Drawing Sheets

PORTABLE PLANER FOR A SINGLE USE STAND

BACKGROUND OF THE INVENTION

1. Field of the Invention

The present invention relates generally to planers and, more specifically, to a portable planer having rails with means for mounting to a single use stand. The planer has a pair of rails with posts depending from the base having threads positioned on the distal ends whereby a stand having been constructed on site and leveled regardless of ground slope has means for receiving the threaded posts whereupon fasteners may be placed on the rail post distal ends thereby the rails form an integral part of said single use stand. The motorized planer is mounted to a carriage having wheels for mounting on said rails whereby the planer can be selectively moved from one rail end to the other. Positioned between the single use rail mounts are supports for placing the work piece for processing with the planer having means for receiving various blades and means for varying the height of the blade relative to the work piece.

The device is designed to manufacture several wood products to include; three sided or "D" shaped logs used in the construction of log buildings, for planing timbers for use in construction of timber frame buildings, for shaping or profiling natural logs for construction of natural log buildings or to custom make to size (height and width) timbers or logs for general construction use.

2. Description of the Prior Art

There are other planer devices designed for shaping a work piece. Typical of these is U.S. Pat. No. 1,583,879 issued to Hallock on May 11, 1926.

Another patent was issued to Bassett on Feb. 3, 1976 as U.S. Pat. No. 3,935,777. Yet another U.S. Pat. No. 4,265,284 was issued to Taylor on May 5, 1981 and still yet another was issued on Apr. 28, 1987 to Elsey as U.S. Pat. No. 4,660,454.

Another patent was issued to Schuler on Apr. 4, 1989 as U.S. Pat. No. 4,817,693. Yet another U.S. Pat. No. 5,201,351 was issued to Hurdle, Jr. on Apr. 13, 1993. Another was issued to Cannaday on Mar. 14, 1995 as U.S. Pat. No. 5,396,938 and still yet another was issued on Jun. 27, 2000 to Greenland as U.S. Pat. No. 6,080,041.

Another patent was issued to Olson on Aug. 22, 2000 as U.S. Pat. No. 6,105,477. Yet another German Patent No. DE4212460 was issued to Buck et al on Oct. 21, 1993. Another was issued to Lavis on May 2, 1984 as U.K. Patent No. GB2128546.

A planer having a table, means forming an inclined surface upon the under side of said table, a slidable wedge engaging said inclined surface, means for sliding said wedge to raise and lower said table, an auxiliary table detachably secured to said table, means forming inclined surfaces upon the under side of said auxiliary table, means engaging said inclined surface and supporting said auxiliary table, and means for actuating said means so as to raise and lower said auxiliary table.

A portable cutting device is provided which comprises a table having first and second frame sections maintained in parallel spaced apart relationship by a plurality of attaching members extending between said first frame section and said second frame section, each of said first and said second frame sections having a longitudinally extending assembly mounted along an upper edge thereof, said longitudinal assemblies having a plurality of spaced apart transverse assemblies mounted thereon and extending substantially perpendicularly therebetween; guide means having a length sufficient to traverse a diagonal of said table and having sufficient rigidity to resist bending under stress and cutting means coacting with said guide to permit said cutting means to transverse a substantial portion of the length of said guide.

A workbench comprises a rigid frame support having telescoped legs to provide adjustable working height and supporting a flat topped work surface. The frame has two widely spaced apart parallel guide rods extending from one side of the work surface, the guide rods having slideable thereon a clamping member to clamp a tool against the adjacent side of the work surface.

A portable bandsaw mill, readily made sufficiently light in weight to be carried by two people, having a saw unit supported on rollers, so that the saw unit can be readily guided and the cut controlled and adjusted manually. A ground-supported support frame or unit provides guide tracks spaced apart on opposite sides of a log or other work piece, on which the saw unit can be rollingly advanced. The ends of the guide tracks are supported in end frames by structure enabling the levels of the guide tracks to be conveniently adjusted for successively lower passes of the saw unit through the log. Guide beam ends are capable of independent adjustment to accommodate differences in level between the four corners of the support unit. A manually advanced rolling saw head of the saw unit includes two bandsaw pulleys, each having a bandsaw blade entrained thereon, one being an idler pulley and the other a drive pulley. The drive pulley, rotatably driven, can be powered by a hydraulic motor, with the actual pressure fluid source separate from the mill. The motor can be readily separable from the saw unit for use in powering other apparatus. The mill can be readily employed for rip sawing logs into boards at any convenient location for example the felling site.

An extension table for a machine tool of the type that includes a machine table that defines a reference plane includes a rigid, straight beam having a lower surface. A ledge is mounted to the lower surface of an outer portion of the beam to extend outwardly from at least one side of the beam, and this ledge defines a continuous upper surface which is substantially coplanar with the lower surface of the beam. The inner portion of the beam is mounted on the machine table with the beam positioned above the machine table such that the outer portion of the beam is cantilevered from the machine table with the lower surface of the beam substantially coplanar with the machine table. The outer portion of the beam is then supported against deflection by a support leg. The beam is sufficiently rigid to ensure that the upper surface of the ledge is substantially coplanar with the machine table. In certain applications the beam is preferably divided into two or more separate beam sections which are held together releasably by coupling elements. A center of one of the beam sections may be affixed to a conventional guide fence of the machine tool to move the extension table laterally across the machine table with the guide fence.

An edger for use with a conventional sawmill, including upper and lower chippers or cutters for forming the upper and lower edges of a board to be removed from a log, mechanical or optical sizers for automatically determining the location of the upper and lower edges of the board, and a control mechanism, responsive to the sizers, for positioning the cutters. The cutters have horizontal or vertical motors with associated blades, and the motors are mounted on carriages which ride up and down on a mast, positioned by a hydraulic cylinder. Mechanical sizing wheels are mounted on separate carriages, and the wheels are urged to contact the log's surface to determine extreme points of narrowness thereof. The extreme motion points of the sizing wheels are recorded by frictionally secured pistons which are sensed by metallic sensors which are input to the control mechanism. An electric eye causes the sizing wheels to move toward and away from the log. During each forward pass of the log toward the saw, the cutters cut the top and bottom edges off the board that the saw will remove from the log, while the sizers profile the log or locate the minimum width points to be used during the succeeding pass of the log to position the cutters. The single channel or double "H-beam" mast has machined sidewalls to which flanges are attached upon which the carriages slide vertically. Linear slide bearings can also attach the carriages to the mast.

Apparatus and method for, in one continuous operation, receiving a slab sawn from a log, sensing the thickness of the slab and setting the apparatus to plane its upper and lower surfaces to produce a desired thickness slab which then is sawn into boards of desired width. The apparatus includes upper and lower planer heads, the upper of which is mounted on adjustable setworks for raising and lowering. At the infeed end of the apparatus a sensor determines the thickness of an entering slab and through control mechanism adjusts the space between the planer heads to plane the slab to a desired common board thickness which is the maximum available from the slab size. A bank of smooth cutting saws downstream from the planer heads saws the slab into smooth-sided boards.

A saw with a compact frame that permits the cutting of large workpieces and that can be repeatedly operated repeatedly without requiring manual activation of an on/off switch. A special pivoting support arm pivots outwardly away from a motor assembly to allow the cutting of large workpieces while allowing the size of the saw to remain relatively compact and portable. An automatic power switch mechanism also is provided to automatically turn on the saw motor upon the placement of a work piece adjacent to the saw blade. The saw table can be slid beyond the frame for the cutting of large workpieces.

A portable sawmill is described that preferably includes a frame-mounted, elongate tub for surrounding a log, the frame mounting adjacent the base of the tub a lateral chain conveyor for rolling the log or advancing it laterally on a frame-mounted lift mechanism for elevating the log as it is ripped by an overhead set of circular saws. The circular saws are double-carriage mounted, with the carriages being a fixed elevation on the frame and with the main and secondary carriages being reciprocally positionable, respectively, along the length and width of the tub above the log. The circular saws preferably include one vertical-swath blade and two vertically separately elevation-adjustable horizontal-swath blades. To one side of the tub, and along the substantial length of the frame, are a plurality of retractable support arms mounted on the frame at a height approximately equal to the elevation of the lateral conveyor at the highest elevation of the lift mechanism. Logs may be lifted as they are processed, and cants produced by such processing may be lifted and moved laterally onto the support arms for further milling. The support arms are automatically retracted from a maximum inward extent to an incrementally, successively retracted position synchronously with lateral movement of the secondary carriage, at the beginning of each of successive passes of the main carriage, to prevent interference between the saw blades and the inward termini of the retractable arms. Structure for spindle-aligning logs, rotating partly squared logs and handling cants while finish milling lumber is described.

The invention discloses a guide rail for hand operated circular saw having a raise rib along which base plate of saw can slide and side clamps to fit over edge of timber. The guide rail is laid on the timber to be cut and its side clamp is pressed against the edge of the timber. The clamp is bolted to the rail by means of a bolt whose head is captive in the hollow underside of the raised rib. The circular saw is mounted on a base plate which has a groove in its underside to fit over the rib and enable the saw to slide and cut along a scribed line parallel to the rib. The end of the clamp acts as a gauge for the rail and sets it along the scribed line.

A power tool mounting assembly which comprises a semi-circular base plate which has a radial arm pivotally connected adjacent the straight edge to the underside of the plate. The arm has a yoke member slidably mounted thereon. A power tool support arm is slidably supported in a cross-head which is pivotally supported in the yoke. The support arm can comprise two parallel, spaced limbs connected to transverse members with one limb being supported in the cross-head. Alternatively, the support arm can comprise a channel member with two parallel, spaced carriage housings fixed thereto for movably supporting the carriage housing on rails fixed to the cross-head. A power tool is detachably supported by the support arm which extends across the base plate above the radial arm. The support arm and power tool can be counter balanced by weights or springs.

While these work stands may be suitable for the purposes for which they were designed, they would not be as suitable for the purposes of the present invention, as hereinafter described.

SUMMARY OF THE PRESENT INVENTION

The present invention discloses a portable planer having rails with means for mounting to a single use stand. The planer has a pair of rails with bolts depending from the base thereof having threads with nuts positioned on the distal ends whereby a stand having been constructed on site and leveled regardless of ground slope has means for receiving the threaded bolts whereupon fasteners may be placed on the rail post distal ends whereby the rails form an integral part of the single use stand. The motorized planer is mounted to a carriage having wheels for mounting on the rails whereby the planer can be selectively moved from one rail end to the other. Positioned between the single use rail mounts are supports for placing the work piece thereon for processing with the planer having means for receiving various blades and means for varying the height of the blade relative to the work piece.

A primary object of the present invention is to provide a gas motorized planer that can be used with a single use stand.

Another object of the present invention is to provide a gas motorized planer mounted to a carriage.

Yet another object of the present invention is to provide a gas motorized planer mounted to a carriage having means for receiving various blade types.

Still yet another object of the present invention is to provide a gas motorized planer having means for varying the blade height relative to a work piece.

Another object of the present invention is to provide a gas motorized planer having a pair of rails for mounting said planer carriage.

Yet another object of the present invention is to provide a portable gas motorized planer having a pair of rails wherein said rails have posts depending therefrom.

Still yet another object of the present invention is to provide portable gas motorized planer having a pair of rails with a plurality of rail posts extending therefrom wherein said posts have threads positioned on the distal ends for mounting fasteners thereto.

Another object of the present invention is to provide a portable gas motorized planer which does not require electric power to operate.

Yet another object of the present invention is to provide a portable gas motorized planer for use where electric power is not available, as in remote locations.

Additional objects of the present invention will appear as the description proceeds. The present invention overcomes the shortcomings of the prior art by providing a portable planer having rails with means for mounting to a single use stand. The planer has a pair of rails with posts depending from the base having threads positioned on the distal ends whereby a stand having been constructed on site and leveled regardless of ground slope has means for receiving said threaded posts whereupon fasteners may be placed on the rail post distal ends thereby said rails form an integral part of said single use stand. The motorized planer is mounted to a carriage having wheels for mounting on said rails whereby said planer can be selectively moved from one rail end to the other. Positioned between the single use rail mounts are supports for placing the work piece during shaping with the planer having means for receiving various blades and means for varying the height of the blade relative to the work piece.

Additionally, the device is designed to manufacture several wood products to include; three sided or "D" shaped logs used in the construction of log buildings, for planing timbers for use in construction of timber frame buildings, for shaping or profiling natural logs for construction of natural log buildings or to custom make to size (height and width) timbers or logs for general construction use.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
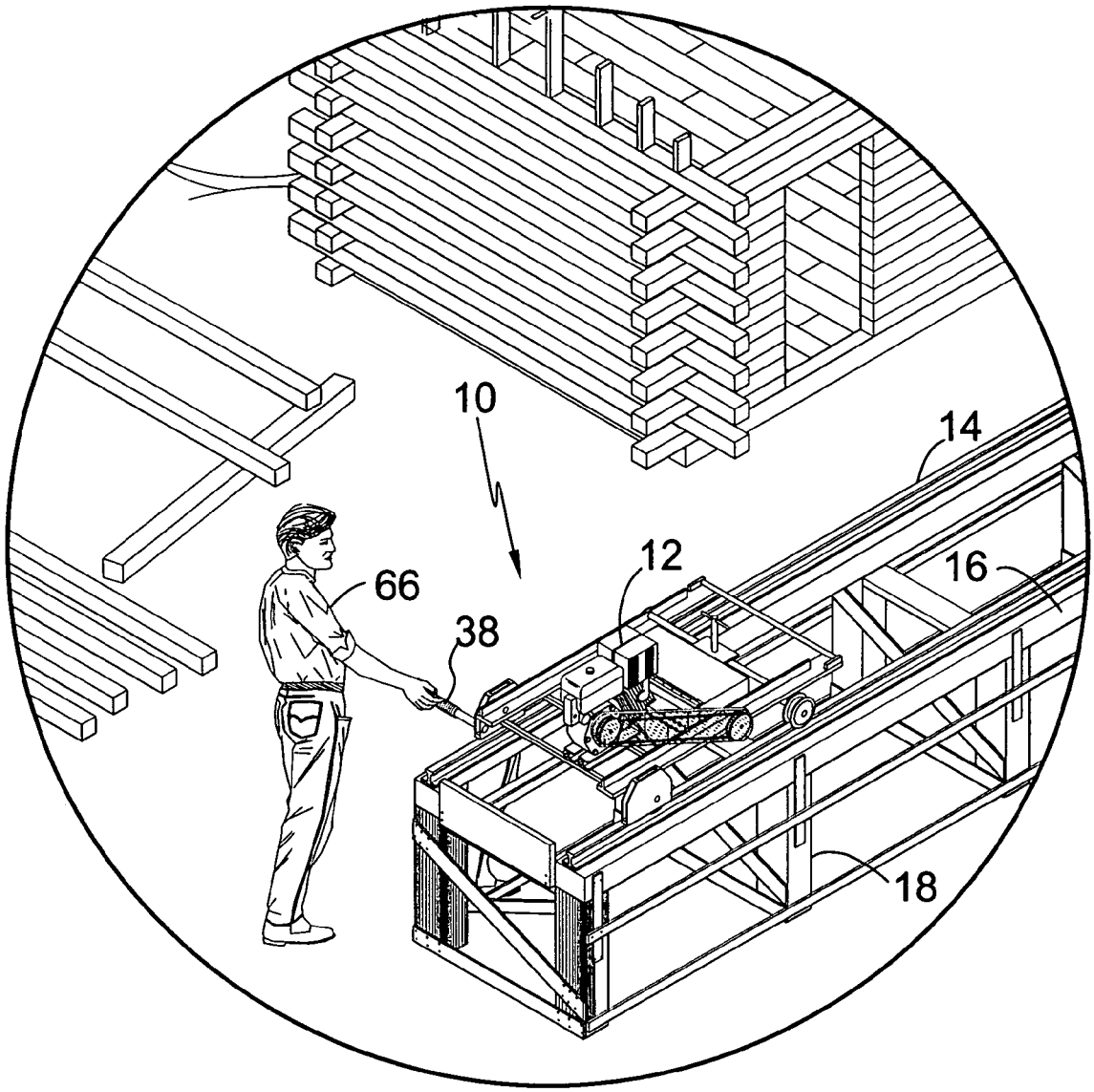
FIG. 1 is an illustrative view of the present invention in use.

With regard to reference numerals used, the following numbering is used throughout the drawings.

10 present invention
12 planer
14 rail
16 horizontal rail support
18 vertical rail support
20 end stop
22 braces
24 nailer
26 work material rest
28 cap nailer
30 planer head safety cover
32 pulley safety cover
34 cover hinge
36 height adjuster
38 push handle
40 carriage
42 wheels
44 gas motor
46 pulley
48 post
50 nut
52 shims
54 rail connector
56 planer blade
58 planer blade
60 planer head
62 lowest position
64 highest position
66 user

DETAILED DESCRIPTION OF THE PREFERRED EMBODIMENT

The following discussion describes in detail one embodiment of the invention. This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10 discloses a portable, manually operable planer 12 showing user 66 grasping handle 38, the planer having means for attaching rails 14 to rail supports 16,18 or guides and comprising a carriage, having a safety cover and riding on the rails with means for adjusting the height of the cutting blade. The device 10 is designed to manufacture several wood products to include; three sided or "D" shaped logs used in the construction of log buildings, for planing timbers for use in construction of timber frame buildings, for shaping or profiling natural logs for construction of natural log buildings or to custom make to size (height and width) timbers or logs for general construction use.

Figure 2:
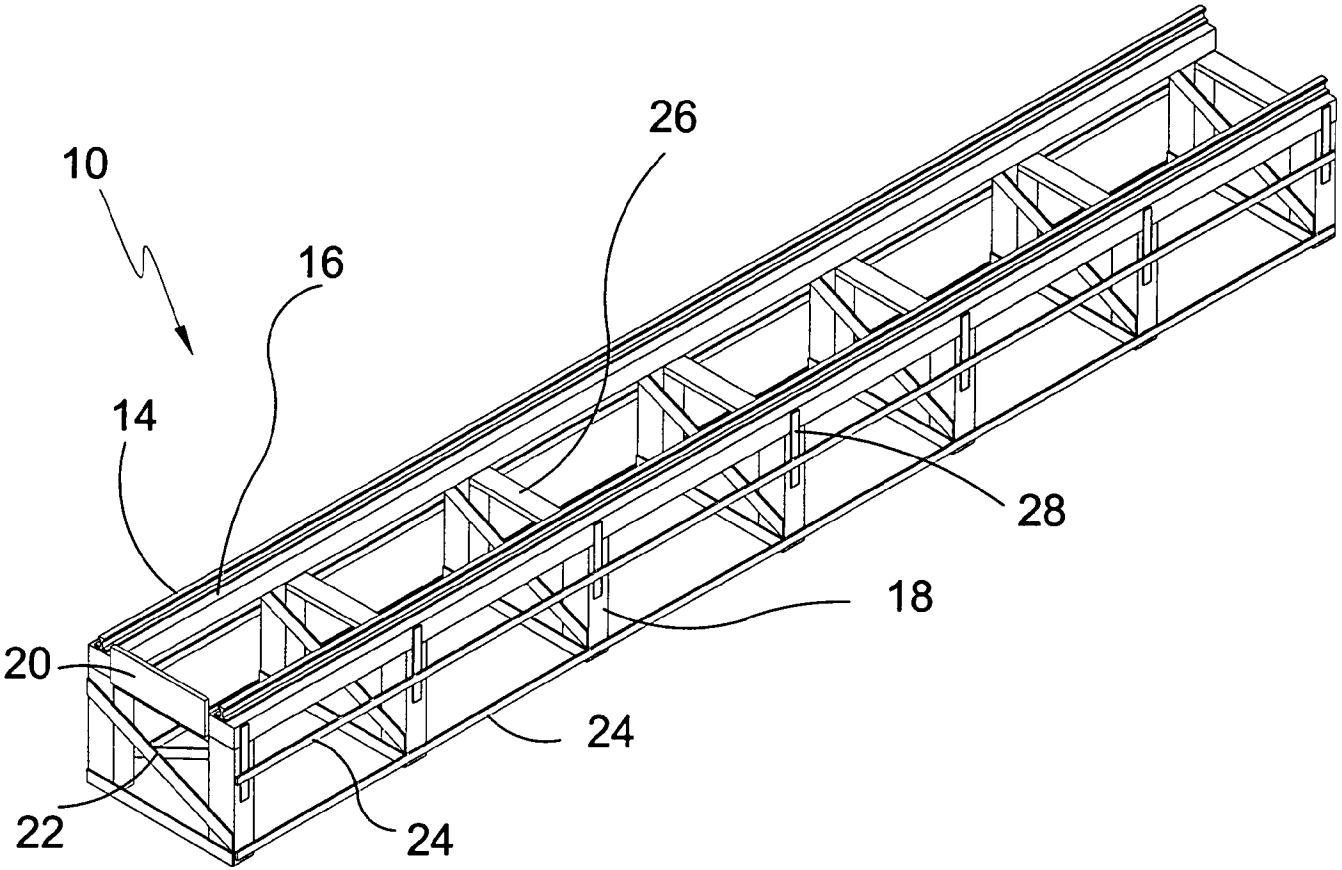
FIG. 2 is a perspective view of the present invention.

Turning to FIG. 2, shown therein is a perspective view of the present invention 10. Shown is the rail 14 and rail support system of the present invention 10 comprising a portable, manually operable planer having means for attaching rails 14 to horizontal 16 and vertical 18 rail supports or guides and comprising a carriage, having a safety cover and riding on the rails with means for adjusting the height of the cutting blade. The device is designed to manufacture several wood products to include; three sided or "D" shaped logs used in the construction of log buildings, for planing timbers for use in construction of timber frame buildings, for shaping or profiling natural logs for construction of natural log buildings or to custom make to size (height and width) timbers or logs for general construction use. Also shown are rail end stop 20, braces 22, nailers 24, work piece or material rest 26, and cap nailer 28.

Figure 3:
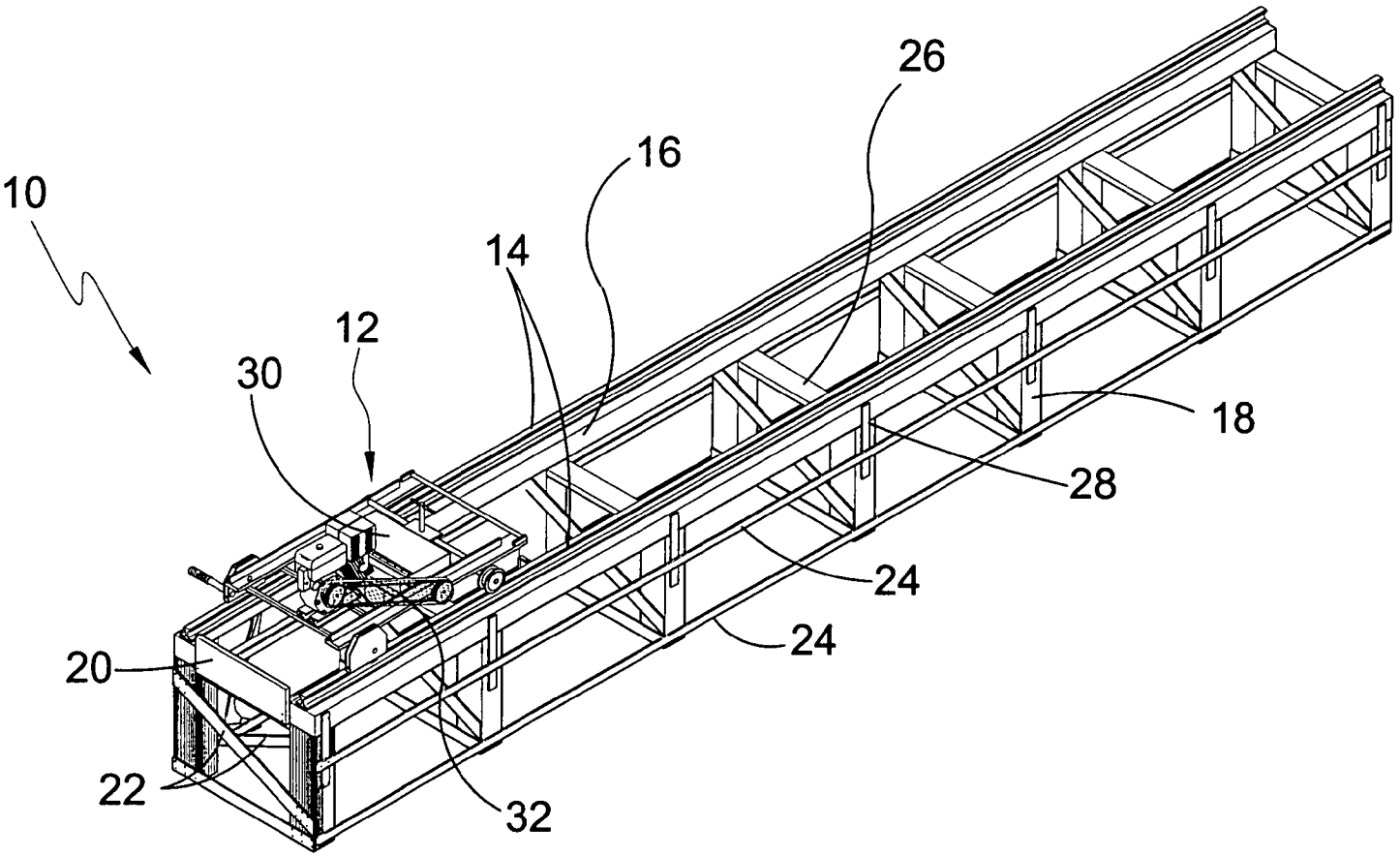
FIG. 3 is a perspective view of the present invention.

Turning to FIG. 3, shown therein is a perspective view of the present invention 10. Shown is the present invention 10 comprising a portable, manually operable planer 12 having means for attaching rails 14 to rail supports or guides 16, 18 and comprising a carriage, having a planer head safety cover 30 and a pulley system also having a safety cover 32 and riding on the rails with means for adjusting the height of the cutting blade. The device 10 is designed to manufacture several wood products to include; three sided or "D" shaped logs used in the construction of log buildings, for planing timbers for use in construction of timber frame buildings, for shaping or profiling natural logs for construction of natural log buildings or to custom make to size (height and width) timbers or logs for general construction use. Also shown are end stop 20, braces 22, nailers 24, work material rest 26, and cap nailer 28.

Figure 4:
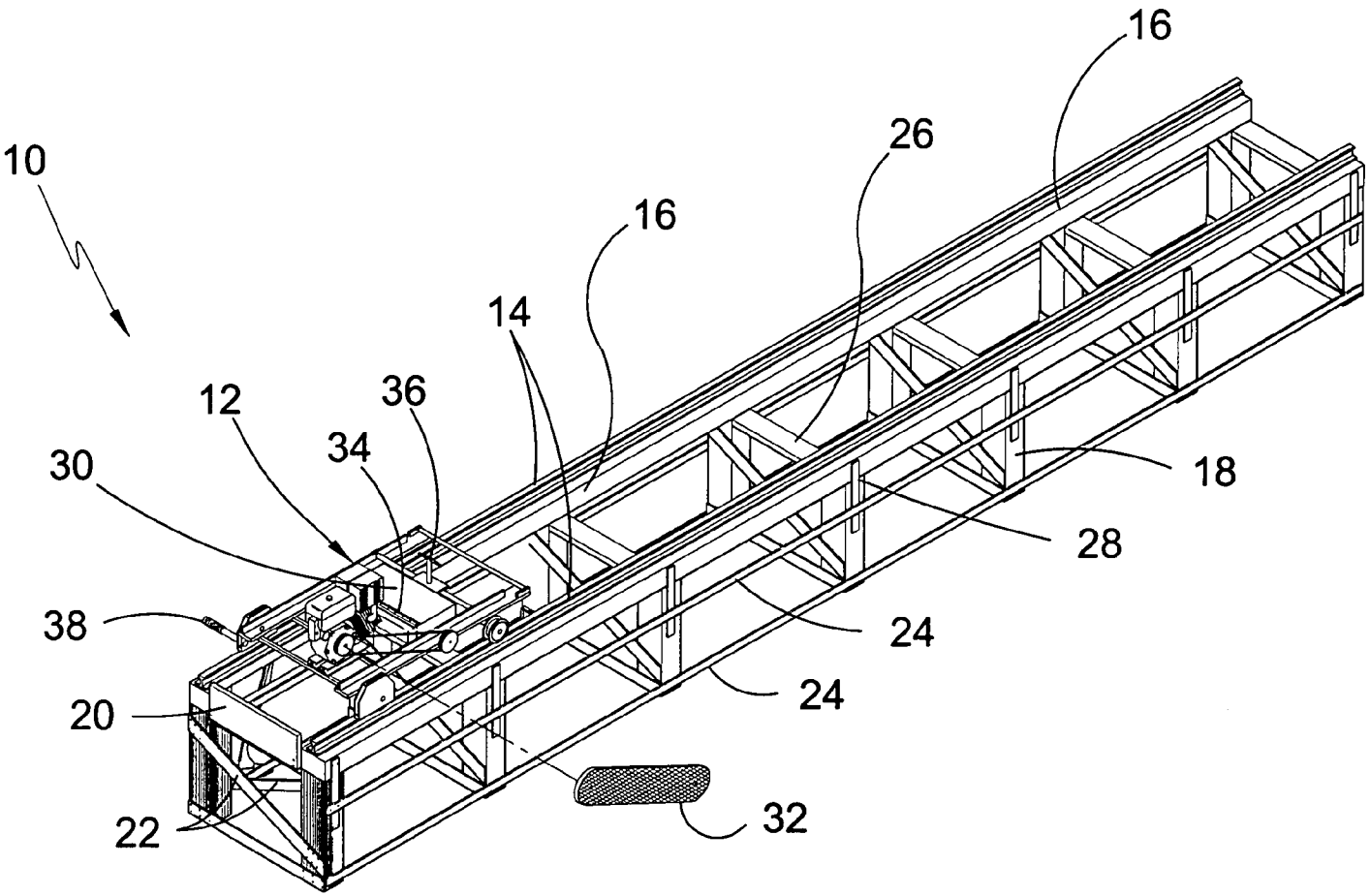
FIG. 4 is a perspective view of the present invention.

Turning to FIG. 4, shown therein is a perspective view of the present invention 10. Shown is the present invention 10 comprising a portable, manually operable planer 12 having means for attaching rails 14 to rail supports or guides 16, 18 and comprising a carriage, having a safety cover 30 with cover hinge 34 and riding on the rails with means for adjusting 36 the height of the cutting blade. The device is designed to manufacture several wood products to include; three sided or "D" shaped logs used in the construction of log buildings, for planing timbers for use in construction of timber frame buildings, for shaping or profiling natural logs for construction of natural log buildings or to custom make to size (height and width) timbers or logs for general construction use. Also shown are push handle 38 and pulley cover 32. Also shown are end stop 20, braces 22, nailers 24, work material rest 26, and cap nailer 28.

Figure 5:
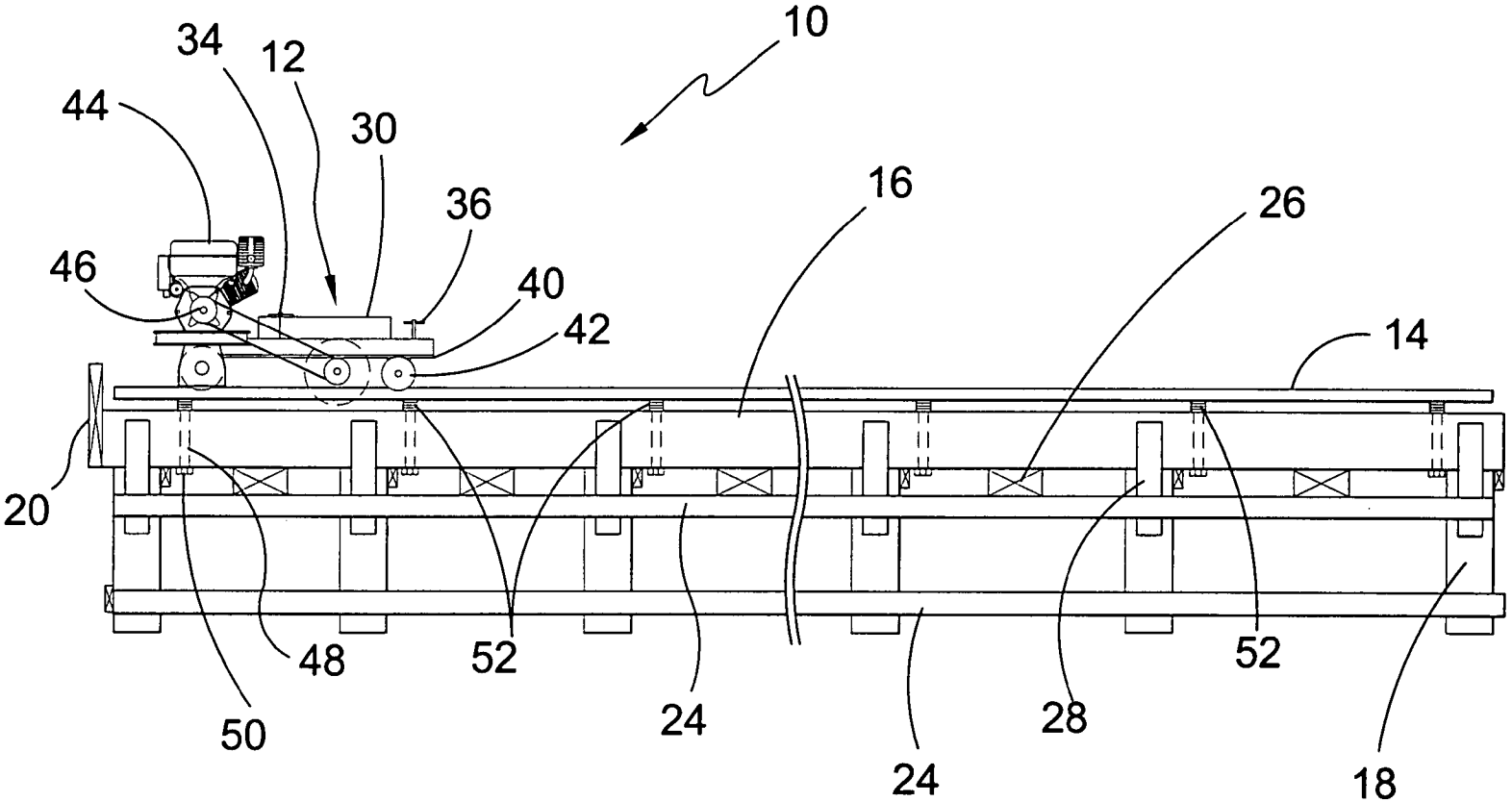
FIG. 5 is a side view of the present invention.

Turning to FIG. 5, shown therein is a side view of the present invention 10. Shown is the present invention 10 comprising a portable, manually operable planer 12 having means for attaching rails 14 to rail supports or guides 16, 18 and comprising a carriage 40 with wheels 42, having a safety cover 30 with hinge 34 and riding on the rails with means for adjusting 36 the height of the cutting blade. The device is designed to manufacture several wood products to include; three sided or "D" shaped logs used in the construction of log buildings, for planing timbers for use in construction of timber frame buildings, for shaping or profiling natural logs for construction of natural log buildings or to custom make to size (height and width) timbers or logs for general construction use. Also shown are gas motor 44, pulley 46, bolt 48, nut 50 and shims 52. Also shown are end stop 20, nailers 24, work material rest 26, and cap nailer 28.

Figure 6:
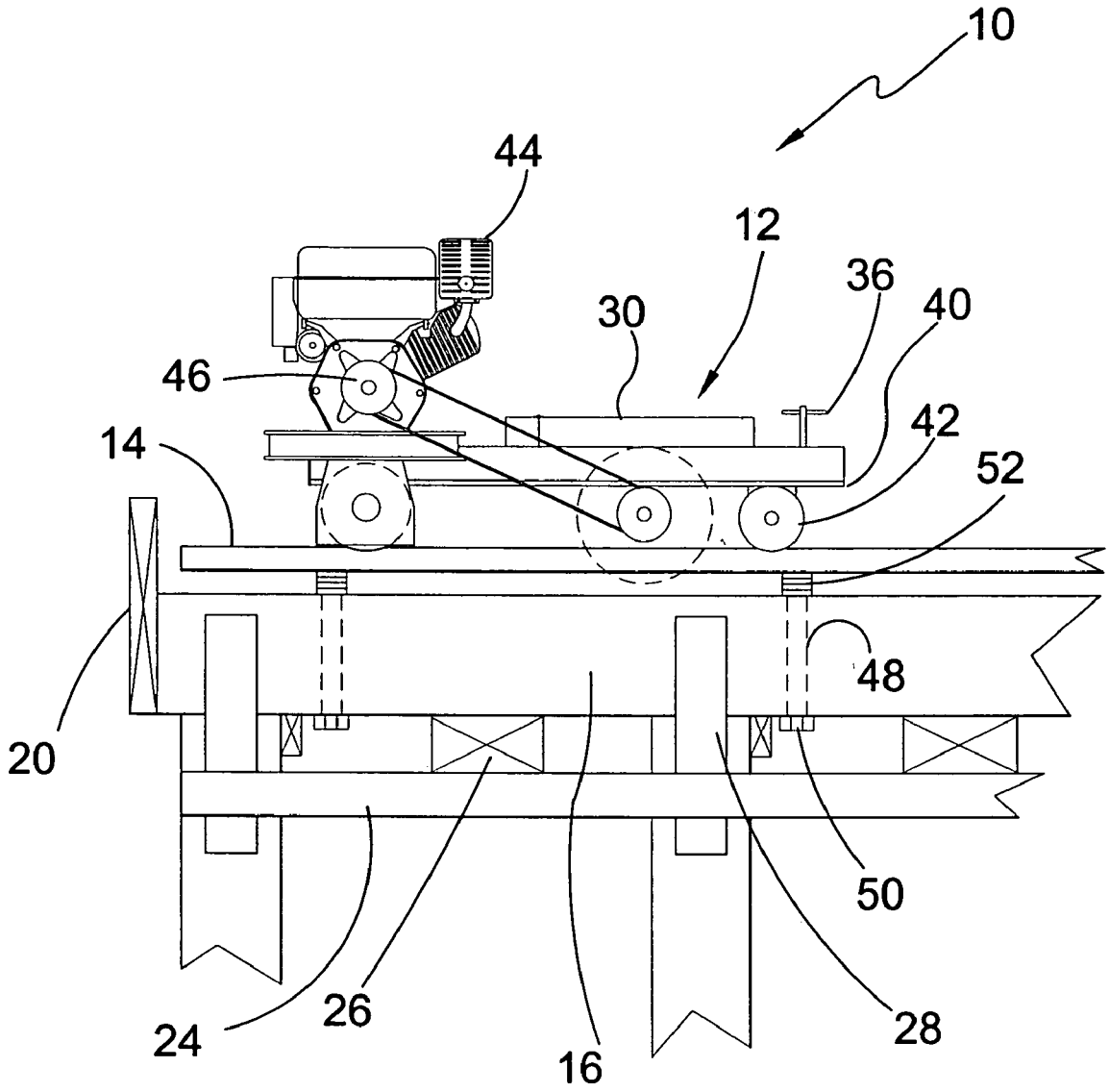
FIG. 6 is a side detailed view of the present invention.

Turning to FIG. 6, shown therein is a side detailed view of the present invention 10. Shown is the present invention 10 comprising a portable, manually operable planer 12 having means for attaching rails 14 to rail supports 16, 18 or guides and comprising a carriage 40 with wheels 42, having a safety cover 30 and riding on the rails with means for adjusting 36 the height of the cutting blade. The device is designed to manufacture several wood products to include; three sided or "D" shaped logs used in the construction of log buildings, for planing timbers for use in construction of timber frame buildings, for shaping or profiling natural logs for construction of natural log buildings or to custom make to size (height and width) timbers or logs for general construction use. Also shown are gas motor 44, pulley 46, bolt 48, nut 50, and shims 52. Also shown are end stop 20, nailers 24, work material rest 26, and cap nailer 28.

Figure 7:
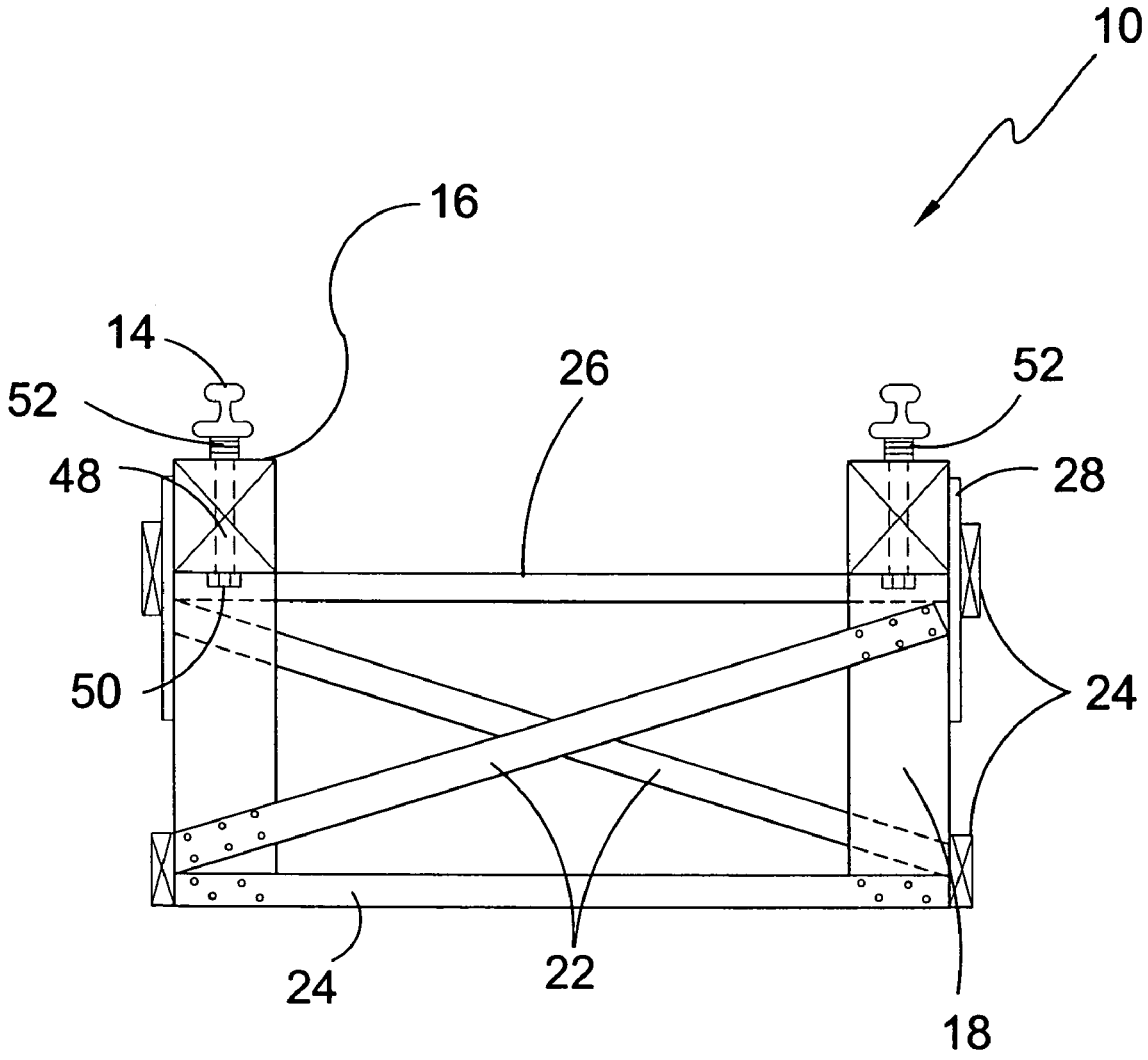
FIG. 7 is an end view of the present invention.

Turning to FIG. 7, shown therein is an end view of the present invention 10. Shown is the present invention 10 comprising a portable, manually operable planer having means for attaching rails 14 to rail supports 16, 18 or guides and comprising a carriage, having a safety cover and riding on the rails with means for adjusting the height of the cutting blade. The device is designed to manufacture several wood products to include; three sided or "D" shaped logs used in the construction of log buildings, for planing timbers for use in construction of timber frame buildings, for shaping or profiling natural logs for construction of natural log buildings or to custom make to size (height and width) timbers or logs for general construction use. Also shown are shims 52, bolt 48 and nut 50. Also shown are end stop 20, braces 22, nailers 24, work material rest 26, and cap nailer 28.

Figure 8:
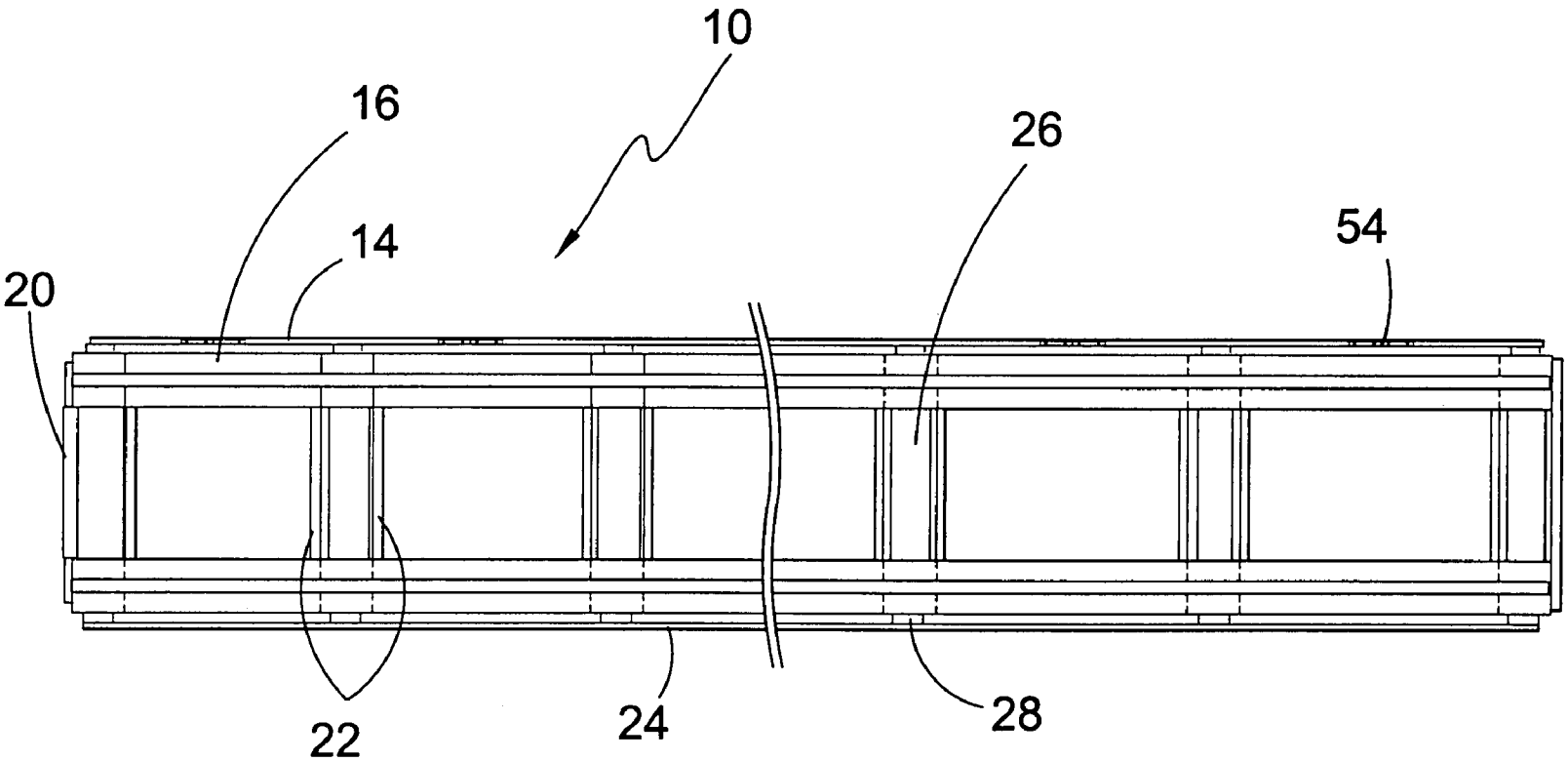
FIG. 8 is a top view of the present invention.

Turning to FIG. 8, shown therein is a top view of the present invention 10. Shown is a top view of the present invention 10 comprising a portable, manually operable planer having means for attaching rails 14 with rail connectors 54 to rail supports 16 or guides and comprising a carriage, having a safety cover and riding on the rails with means for adjusting the height of the cutting blade. The device is designed to manufacture several wood products to include; three sided or "D" shaped logs used in the construction of log buildings, for planing timbers for use in construction of timber frame buildings, for shaping or profiling natural logs for construction of natural log buildings or to custom make to size (height and width) timbers or logs for general construction use. Also shown are end stop 20, braces 22, nailers 24, work material rest 26, and cap nailer 28.

Figure 9:
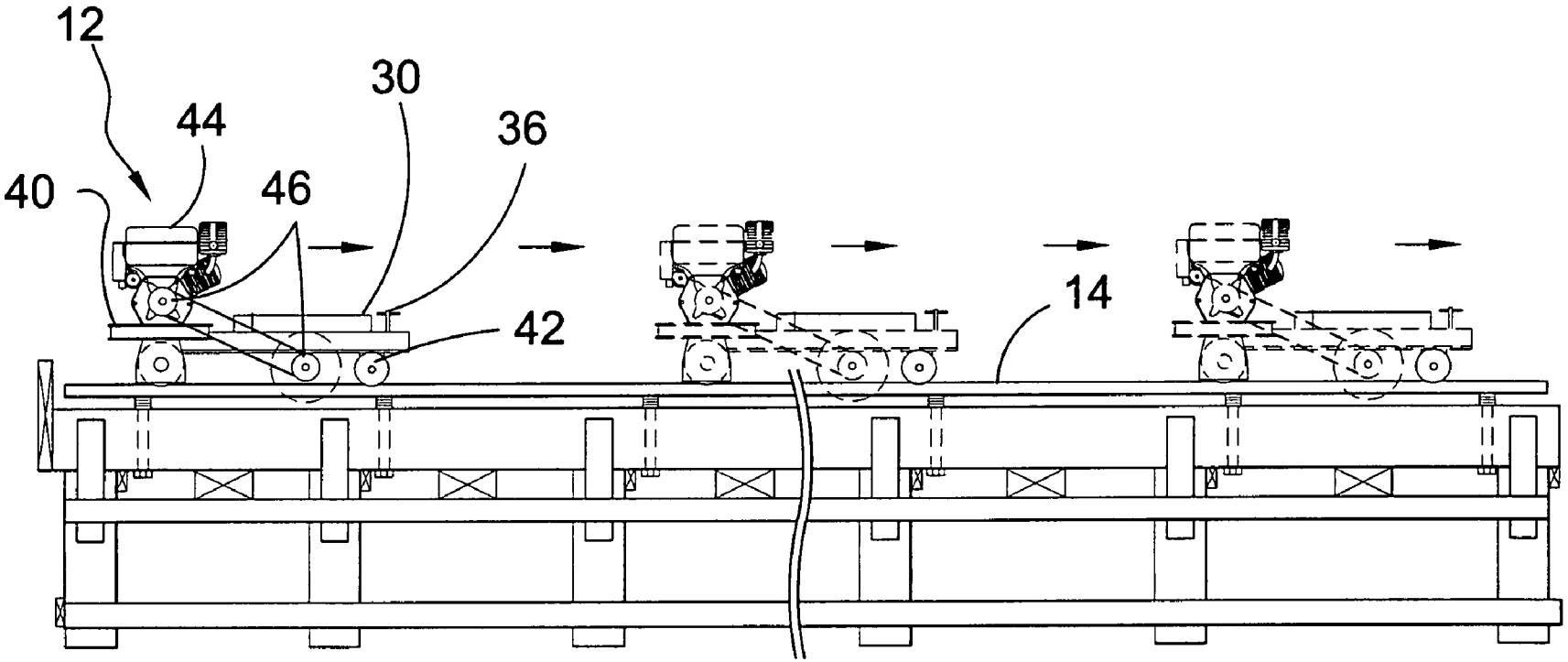
FIG. 9 is a side view of the present invention.

Turning to FIG. 9, shown therein is a side view of the present invention 10. Shown is a side view of the present invention 10 comprising a portable, manually operable planer 12 with gas motor 44 and pulley 46 having means for attaching rails to rail supports or guides and comprising a carriage 40 with wheels 42, having a safety cover 30 and riding on the rails with means for adjusting the height 36 of the cutting blade. The device is designed to manufacture several wood products to include; three sided or "D" shaped logs used in the construction of log buildings, for planing timbers for use in construction of timber frame buildings, for shaping or profiling natural logs for construction of natural log buildings or to custom make to size (height and width) timbers or logs for general construction use.

Figure 10:
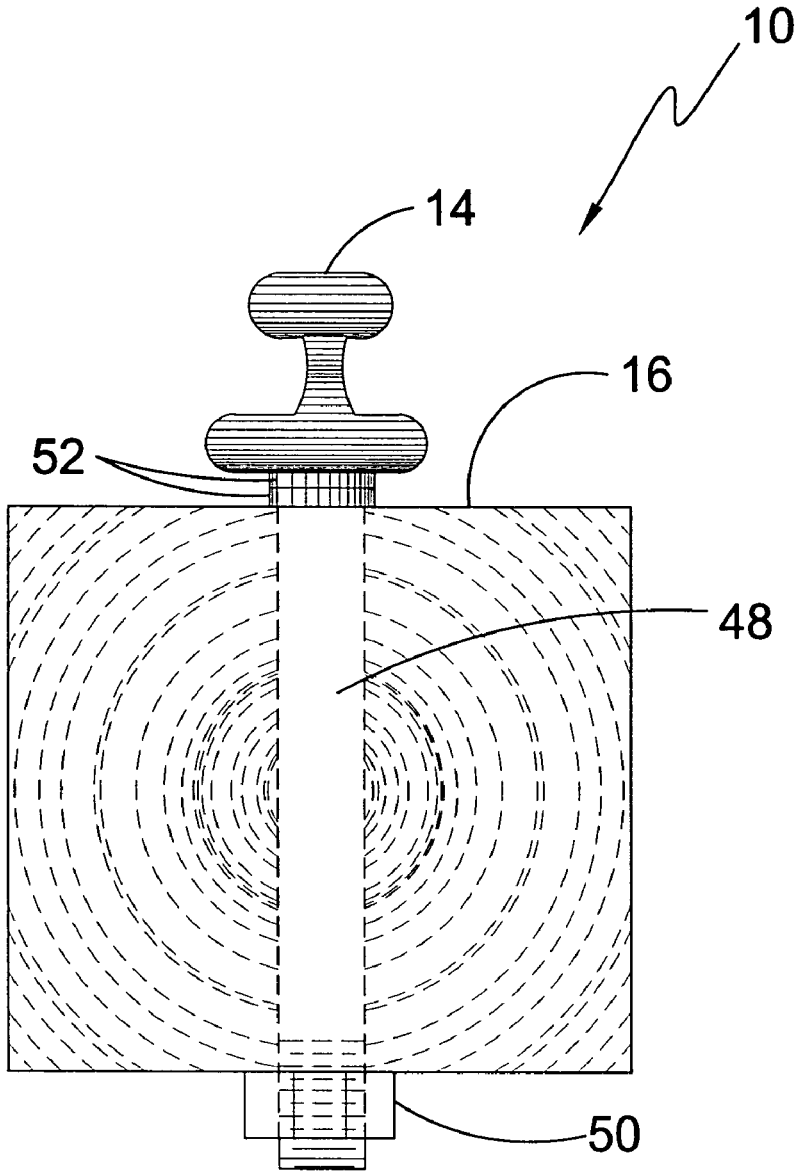
FIG. 10 is a sectional view of the present invention.

Turning to FIG. 10, shown therein is a sectional view of the present invention 10. Shown is a sectional view of the rail 14 and rail support 16. A bolt or post 48 is welded to the under side of the rail 14 and is secured to the rail support 16 by a nut 50. Washers or shims 52 are added between the rail 14 and rail support 16 to adjust the height by adding or removing the washers or shims.

Figure 11:
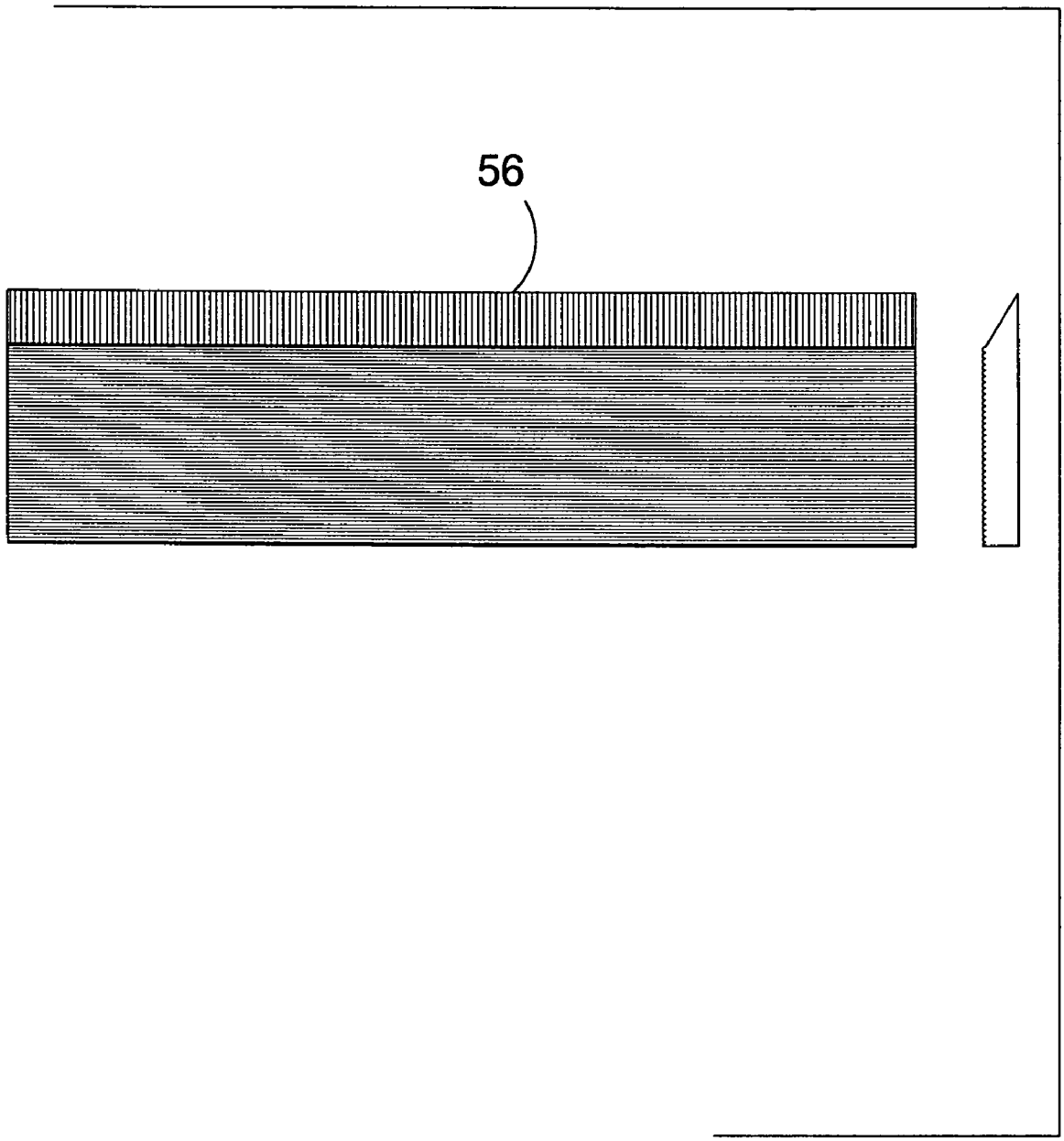
FIG. 11 is a view of one type of planer blade that can be used with the present invention

Turning to FIG. 11, shown therein is a view of one type of planer blade 56 that can be used with the present invention. Shown is a planer blade 56 of the present invention having a flat surface knife blade.

Figure 12:
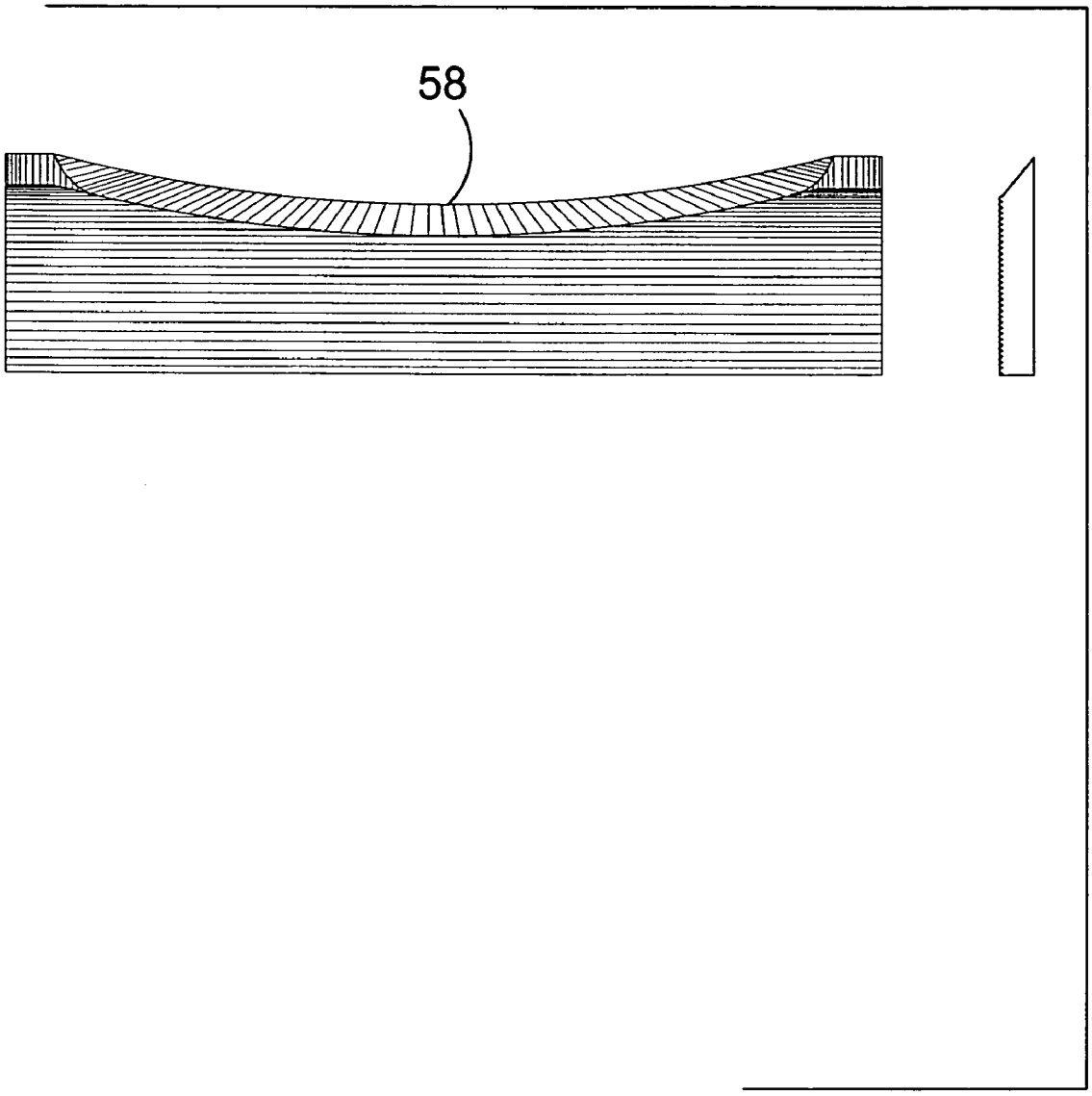
FIG. 12 is a view of another type of planer blade that can be used with the present invention

Turning to FIG. 12, shown therein is a view of another type of planer blade 58 that can be used with the present invention. Shown is a planer blade 58 of the present invention having a curved blade for forming a concave surface that when used in conjunction with a straight blade can form lumber having a substantially "D" shape in cross section.

Figure 13:
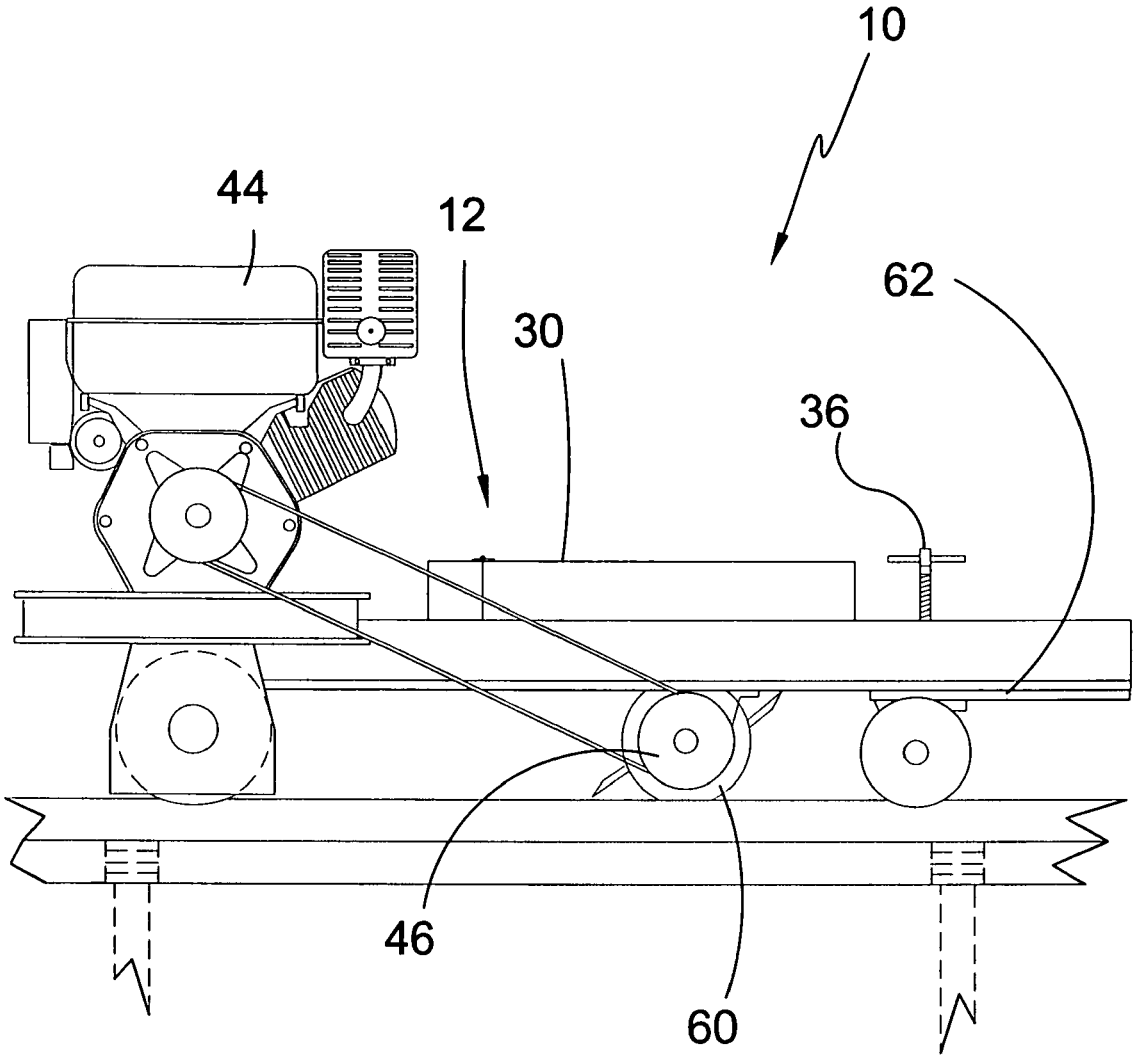
FIG. 13 is a side view of a planer blade of the present invention in its lowest setting.

Turning to FIG. 13, shown therein is a side view of the planer assembly in its lowest setting. Shown is the present invention 10 comprised of a plane 12 mounted on rails fastened to a stand having means for adjusting the planer head or blade 60 relative to the work piece. The plane 12 has a gas powered engine 44 mounted on a carriage in communication with a cutting head 60 by means of a pulley 46 and belt. The stand can be constructed on site to suit the type of timbers or lumber desired. The device is designed to manufacture several wood products to include; three sided or "D" shaped logs used in the construction of log buildings, for planing timbers for use in construction of timber frame buildings, for shaping or profiling natural logs for construction of natural log buildings or to custom make to size (height and width) timbers or logs for general construction use. Also shown are planer cover 30, height adjuster 36 showing the lowest position of the planer head at 62.

Figure 14:
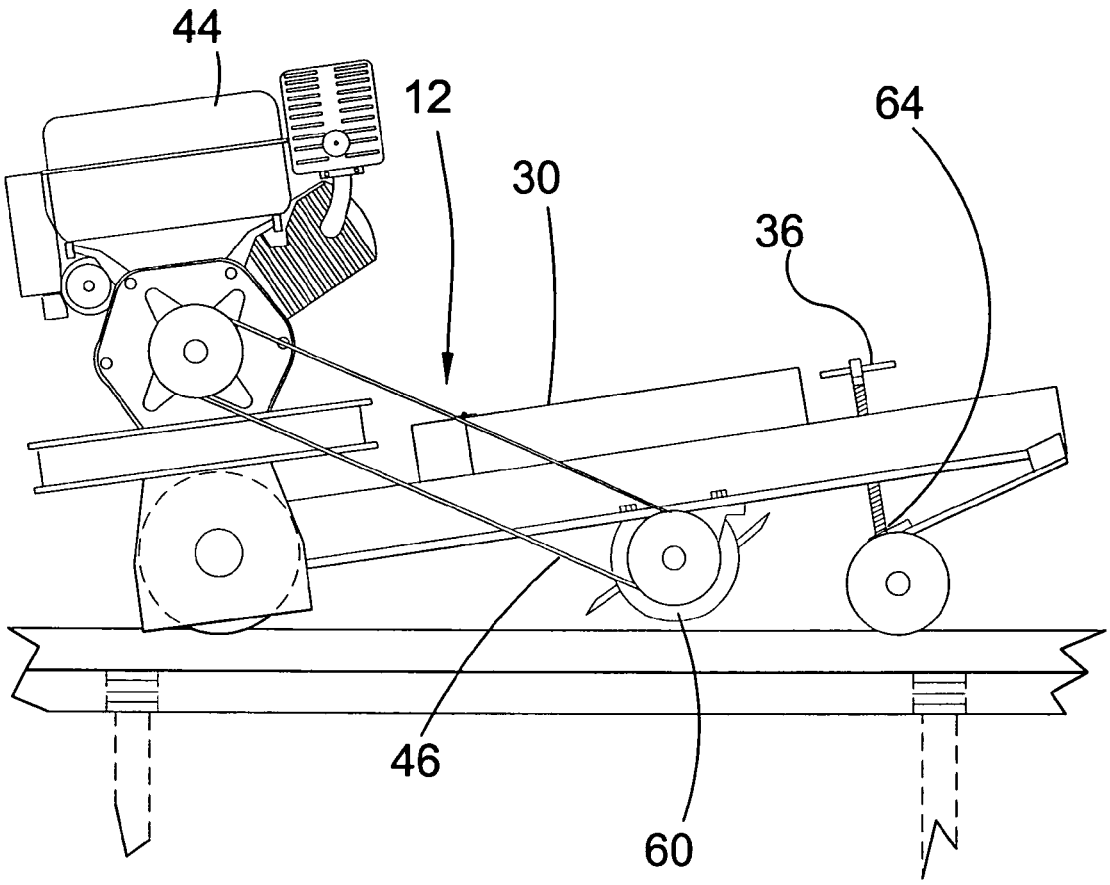
FIG. 14 is a side view of a planer blade of the present invention in its highest setting.

Turning to FIG. 14, shown therein is a side view of a planer blade 60 of the present invention in its highest setting at 64. Shown is the present invention comprised of a plane 12 mounted on rails fastened to a stand having means for adjusting the blade 60 relative to the work piece. The plane 12 has a gas powered engine 44 mounted on a carriage in communication with a cutting head by means of a belt. The stand can be constructed on site to suit the type of timbers or lumber desired. The device is designed to manufacture several wood products to include; three sided or "D" shaped logs used in the construction of log buildings, for planing timbers for use in construction of timber frame buildings, for shaping or profiling natural logs for construction of natural log buildings or to custom make to size (height and width) timbers or logs for general construction use. Also shown are planer cover 30, height adjuster 36 showing the highest position of the planer head at 64.

Figure 15:
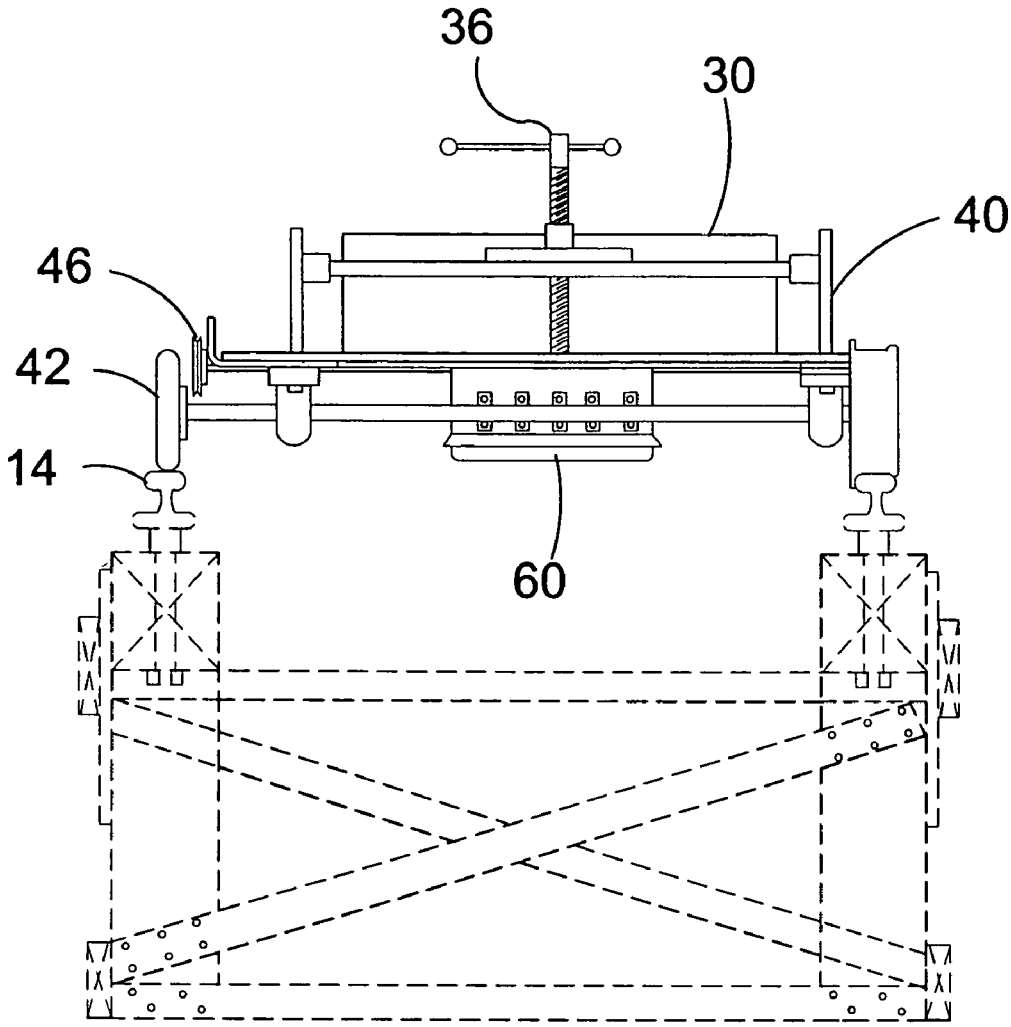
FIG. 15 is a front view of a planer blade and adjustment system of the present invention.

Turning to FIG. 15, shown therein is a front view of a planer blade 60 and adjustment system of the present invention. Shown is the present invention comprised of a plane mounted on rails 14 fastened to a stand having means for adjusting the blade relative to the work piece. The plane has a gas powered engine mounted on a carriage 40 with wheels 42 in communication with a cutting head 60 by means of a belt. The stand can be constructed on site to suit the type of timbers or lumber desired. The device is designed to manufacture several wood products to include; three sided or "D" shaped logs used in the construction of log buildings, for planing timbers for use in construction of timber frame buildings, for shaping or profiling natural logs for construction of natural log buildings or to custom make to size (height and width) timbers or logs for general construction use. Also shown are planer cover 30, height adjuster 36 and pulley 46.

I claim:

1. A portable planer for a single use support stand, comprising:

a) a portable planer disposed on a carriage, said carriage having front and rear opposing ends, a pair of opposing sides, a top and a bottom, a plurality of wheels disposed on said bottom of said carriage to permit the planer to roll on the wheels;

b) a pair of rails for receiving said wheels so that said planer can roll on said rails, said rails being parallel to each other, spaced apart, and substantially horizontal, said rails having first and second opposing ends to permit the planer to move from one end to the other end, said rails having a top and bottom;

c) a support for said rails to permit the planer to be disposed at an elevation above the ground;

d) means for attaching said rails to said support whereby the pair of rails are secured to the support;

e) a work piece support disposed between said rails adjacent said bottom of said planer to permit a work piece to be placed on the work piece support so that the work piece can be contacted by the planer;

f) a first planer blade being disposed on said planer, said first planer blade having a straight cutting edge for cutting a work piece; and g) a second planer blade being disposed on said planer, said second planer blade having a curved blade for use with said first planer blade having said straight cutting edge for forming a product having a "D" shaped cross section.

2. The portable planer of claim 1, wherein said support for said rails further comprises horizontal and vertical support members connected to each other by a plurality of braces and nailers.

3. The portable planer of claim 2, further comprising a plurality of downwardly extending posts each having a first end secured to said bottom of said rails wherein said second end of each said post extends through said horizontal support member, said second end of each said post further comprising a fastener for securing said second end to said horizontal support member.

4. The portable planer of claim 3, further comprising threads being disposed on said second end of each said post, said threads for receiving a mating nut to permit the second end of the post to be secured to the horizontal support member.

5. The portable planer of claim 4, wherein said first end of each said post is welded to said bottom of said rails.

6. The portable planer of claim 5, further comprising at least one shim being disposed between said first end of each said post and said horizontal support member to permit the rails to be leveled.

7. The portable planer of claim 1, further comprising a height adjustment for said blades to permit the height of the blades with respect to the work piece to be varied.

8. The portable planer of claim 7, further comprising a safety cover being disposed over said blades.

9. The portable planer of claim 8, wherein said safety cover is hinged to permit access to the blades of the planer.

10. The portable planer of claim 9, further comprising a handle being disposed on said planer to permit a user to manually move the planer along the rails.

11. The portable planer of claim 10, further comprising a gasoline motor being disposed on said planer to power the blades of the planer.

12. The portable planer of claim 11, further comprising a pulley and belt drive for connecting said motor to said blades to permit the blades to be turned by the motor.

13. The portable planer of claim 12, further comprising a pulley cover being disposed on said pulley and belt drive.

14. The portable planer of claim 13, further comprising a plurality of rail connectors for connecting said ends of said rails to each other to permit sections of rails to be formed.

15. The portable planer of claim 14, further comprising at least one rail stop being disposed on said end of said rails to permit the planer to be stopped at the end of the rails.

* * * * *